United States Patent [19]

Lankton

[11] Patent Number: 4,534,464

[45] Date of Patent: Aug. 13, 1985

[54] MANUFACTURE AND USE OF CLOSELY SPACED ATTACHMENTS

[75] Inventor: Gordon B. Lankton, West Boylston, Mass.

[73] Assignee: Nypro Inc., Clinton, Mass.

[21] Appl. No.: 448,030

[22] Filed: Dec. 8, 1982

[51] Int. Cl.[3] ..... A44B 9/00; B65D 85/24; G09F 3/12

[52] U.S. Cl. ..... 206/343; 24/150 FP; 40/24; 206/346; 206/820; 227/73; 227/76

[58] Field of Search ..... 40/2 R, 20 R, 21 R, 40/24; 24/150 B, 150 FP, 150 R, 201 A, 72.7; 206/338, 339, 340, 341, 342, 343, 344, 345, 346, 380, 820; 292/322; 227/67, 73, 76

[56] References Cited

U.S. PATENT DOCUMENTS

| | | | |
|---|---|---|---|
| 2,954,602 | 10/1960 | Derby | 206/343 |
| 3,273,705 | 9/1966 | Rieger et al. | 24/150 FP |
| 3,481,459 | 12/1969 | Becht | 206/343 |
| 3,733,657 | 5/1973 | Lankton | 206/343 |
| 3,756,391 | 9/1973 | Keck et al. | 206/343 |
| 4,263,730 | 4/1981 | Clements | 40/20 R |
| 4,417,656 | 11/1983 | Kato | 206/820 |

FOREIGN PATENT DOCUMENTS

| | | | |
|---|---|---|---|
| 2558952 | 7/1977 | Fed. Rep. of Germany | 40/20 R |

*Primary Examiner*—George E. Lowrance
*Assistant Examiner*—Jimmy G. Foster
*Attorney, Agent, or Firm*—Robert L. Nathans

[57] ABSTRACT

An assembly of closely spaced attachments, a method of manufacturing an assembly of closely spaced attachments and a method of applying interleaved attachments to objects. The assembly has alternating attachments having different types of heads and having different lengths. The shorter attachments may be subsequently stretched to engage the longer attachments. In this manner the spacing between attachments can be decreased. One result of using such an assembly with a conventional dispensing device is that the advancing mechanism of the device can advance attachments two at a time by only contacting a single position at every other attachment in the assembly.

17 Claims, 15 Drawing Figures

MANUFACTURE AND USE OF CLOSELY SPACED ATTACHMENTS

BACKGROUND OF THE INVENTION

This invention relates to closely spaced attachments, and, more particularly, to their use and manufacture.

Attachments are widely used in the coupling of objects. In many cases the coupling is of a price tag to a garment or some other article of merchandise.

One type of attachment and dispensing gun found to be particularly suitable and versatile is as shown in U.S. Pat. No. 3,103,666, issued Sept. 16, 1963. Individual ones of the attachments are positioned on a common mounting element to form "a clip", and are spaced from one another according to the interval required for proper operation of the dispensing gun.

Each individual attachment in the '666 patent is formed by a dispensing member, or cross bar, at the base of an elongated filament-like connector which extends to a head or paddle. Each dispensing member, or cross bar, is joined to a common mounting element of the clip.

In the dispensing of individual attachments, the clip formed by the mounting element and the attachments is inserted into the dispenser, and the cross bar of the first attachment is advanced to a position for being dispensed through a slotted hollow needle by a plunger.

The slot in the needle permits the elongated filamentary connector to be expelled at the same time as the cross bar. If the needle has been used to penetrate, for example, a price marking tag and an article of merchandise, expulsion of the attachment causes the cross bar to be released from the needle on the reverse side of the article. When the needle is subsequently withdrawn from the article the connector of the attachment extends from the cross bar through the front side of the article and supports the price marking tag against the head of the attachment. The attachments of the '666 patent can be significantly improved by stretching their connectors as disclosed in U.S. Pat. No. 3,444,597 which issued May 28, 1969. Such attachments can be manufactured in accordance with U.S. Pat. No. 3,380,122 which issued Apr. 30, 1968.

In practice, it has been necessary to have a minimum separation between individual fasteners attached to the common mounting element of the clip. While it would be desirable to pack the fasteners more closely than in the '666 patent, physical limitations encountered in molding have prevented the attainment of tightly packed clips.

Accordingly, it is an object of the invention to decrease spacing of individual attachments of clips of attachments commonly used in the coupling of objects. A related object is to decrease the spacing between attachments over and above that achieved in U.S. Pat. Nos. 3,103,666, 3,380,122 and 3,444,597.

If an attempt is made to decrease the spacing of attachments by decreasing the mold distances between individual attachments, there is a physical limitation caused by the need to maintain a finite wall thickness between adjoining attachments. This problem is particularly acute at the paddle regions of the attachment, since the paddles involve comparatively large adjoining surfaces.

When an attempt is made to decrease wall thickness, compensation is necessary either by seeking to produce molds of more durable materials, or by operating the molds under less rigorous conditions. Since users of attachments prefer thin and flexible connectors, the molds must be operated with comparatively narrow orifices under high pressure. When such molds are fabricated with comparatively thin walls, either the injection pressures must be reduced or the wall strenghtened in some other fashion in order to prevent internal damage to the mold.

Accordingly, it is another object of the invention to decrease the spacing between adjoining attachments of a clip without requiring unduly thin wall sections in the molds used to form the attachments. A related object is to decrease spacing between adjoining paddle members of a clip of attachments without the need for excessively thin wall thicknesses in the associated molds.

A further object of the invention is to enhance the mold life of molds used to produce clips of closely spaced attachments. A related object is to permit the molding of closely spaced attachments without impairment of the operating parameters used in conventional molding practice.

Because of the widespread use and general acceptance of standard fasteners of the type shown in U.S. Pat. No. 3,103,666 and the dispenser disclosed in that patent, an extensive line of modernized dispensing devices has been developed that are based on the original dispenser of that patent. These devices are all designed to be used with clips that have a standard spacing of attachments.

It is yet another object of the invention to decrease the spacing of attachments while simultaneously permitting such attachments to be used with standard dispensers that are now in widespread use.

SUMMARY OF THE INVENTION

In accomplishing the foregoing and related objects, the invention provides for decreasing the spacing between adjoining attachments of a clip by molding the attachments with different configurations in which the attachments of one configuration are longer than those of another. In this way the paddle portion of one set of attachments can be displaced from the paddle portion of adjoining set of attachments. This permits the close spacing of attachments without having the excessively thin walls between adjoining paddles that could exist if all of the attachments were initially molded of the same length.

In accordance with one aspect of the invention, the attachments of the one configuration are interleaved with those of the other. When the attachments are in linear alignment the result is a molded clip in which the individual attachments alternate in length.

In accordance with another aspect of the invention, the attachments which are longer than the others are releasably joined by a common support element.

In accordance with a further aspect of the invention, the common support element is joined to the enlarged or paddle portions of the attachments. It is advantageous for the common support element to be disposed symmetrically at the top edges of the paddles and be perpendicular to their faces.

In accordance with still another aspect of the invention, selected ones of the attachments are also joined to a common mounting element. For this purpose the joinder may be made by neck elements that extend from the common mounting element to the dispensing members of attachments of either the first or second configuration. Since the attachments with reduced spacing in accordance with the invention are intended to be used with standard dispensing devices, the connections to the common mounting element desirably have approximately the same pitch as conventional clips of attachments. In a particular embodiment of the invention, where the spacing is approximately halved, a connection to the common mounting element is made for every other attachment. This connection may be to the longer or shorter individual attachments as desired.

In accordance with yet another aspect of the invention, the attachments are subjected to stretching which commences with the stretching of the shorter attachments to be the same length as the initially molded longer attachments. Where desired, the stretching may be continued to stretch the longer attachments as well. The result is a clip of stretched attachments each having the same overall length. Moreover, it is advantageous to promote stretching by tapering the filamentary connectors so that they have their smallest diameter in the vicinity of their cross bars and their greatest diameter in the vicinity of their heads.

In accordance with a still further aspect of the invention, the longer individual attachments are provided with means for engaging and holding the shorter attachments after they have been stretched into relative alignment with the longer attachments. For that purpose a plurality of protuberances can be provided on the face of each paddle of the longer attachments. A mating protuberence is then included on the face of the adjoining shorter paddle. When the latter is stretched to the level of the longer paddles, an interlock takes place between the adjoining paddles. The protuberences desirably are in the form of cylindrical surfaces which extend along the face of each paddle.

DESCRIPTION OF DRAWINGS

Other aspects of the invention will become apparent after considering several illustrative embodiments taken in conjunction with the drawings, in which.

DETAILED DESCRIPTION

Figure 1:
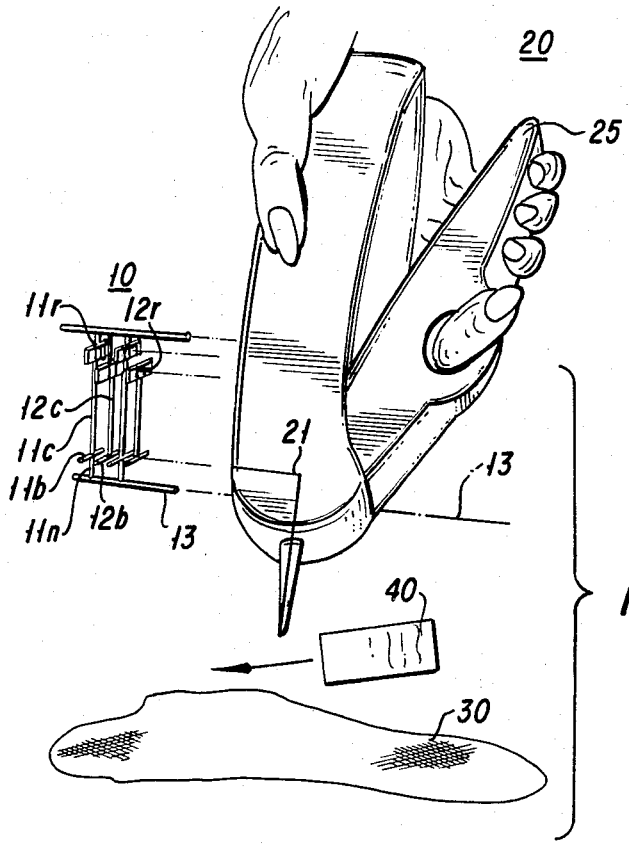
FIG. 1 is a schematic view of showing a clip of attachments in accordance with the invention being used with a dispensing device.

With reference to the drawings, FIG. 1 shows a clip 10 of attachments in accordance with the invention in position for use with a dispensing device 20 to tag an article of merchandise 30 with a price ticket 40.

The clip 10 includes individual attachments 11-1 through **11-*n*, and 12-1 through 12-*n*. The attachments of the "11" series have connectors 11*c* which are longer than the corresponding connectors 12*c* of the shorter attachments of the "12" series. The entire set of individual attachments 11 and 12 is secured to a mounting bar 13, with the longer attachments 11 connected directly to the mounting bar 13 by a neck 11*n* to a dispensing element or cross bar 11*b*, and the shorter attachments 12 are indirectly connected at their cross bar 12*b*** through the longer attachments as more specifically described below.

The clip 10 is applied to the dispenser 20 by insertion of the mounting bar 13 into an internal channel 21. The first undispensed attachment 11-1 is moved into the channel 21 into position for being dispensed with its dispensing member or cross bar **11*b* (not visible in FIG. 1) in alignment with the bore of a slotted hollow needle 24. The tag 40 is positioned on the needle 24 and the desired dispensing then takes place by compressing the lever actuator 25 of the dispenser 20**.

Figure 2:
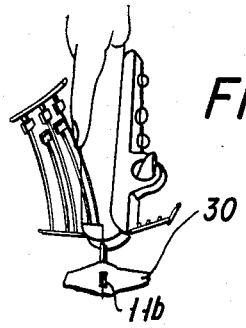
FIG. 2 is a view similar to that of FIG. 1 in which the needle of the dispensing device has penetrated the article to be tagged.
Figure 3:
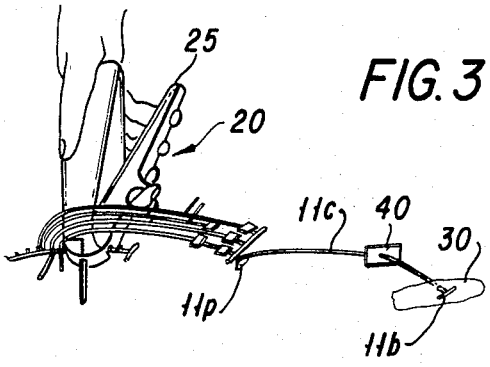
FIG. 3 is a view showing the dispensing device of FIG. 2 after having been withdrawn from the article being marked leaving the article tagged as desired.

The dispenser 20 is then as shown in FIG. 2 with the cross bar **11*b* in the course of being emitted from the needle. Expulsion of the cross bar 11*b* causes it to adopt its original orientation relative to the connector 11*c* on the reverse side of the article 30 as shown in FIG. 3, with the price tag 40 on the connector 11*c***.

The foregoing cycle is then repeated for another article, causing the feed of the next attachment 12-1 in the same manner described previously except that the attachment 12-1 is shorter than the attachment 11-1 and is indirectly connected to the mounting element 13.

As indicated in FIG. 1 the attachments 11 are directly connected to the mounting element 13 by short necks **11*n*. These necks 11*n* are spaced from one another on the mounting element 13 by an interval which allows the clip 10 to be accommodated by conventional dispensers such as the dispenser 20. The inclusion in the clip 10 of the shorter element 12**, however, represents a 50 percent reduction in the spacing between adjoining attachments.

To allow the more closely spaced attachments to be fed by conventional dispensers, the conventional neck connectors **11*n* are retained. The dispenser 20 is nevertheless able to feed the interspersed attachments 12 because, although the feed mechanism acts against the next neck 11*n* of the next elongated attachment, e.g. 11-2, the forward rotation of the feed mechanism is temporarily terminated when the shorter attachment, e.g. 12-1, has its dispensing member or cross bar 12*b* positioned at the mouth of the dispensing needle 24**.

The feeding of the next longer attachment 11-2 is then completed after the shorter attachment 12-1 is expelled. As a result, the invention is able to provide for the feed of closely spaced attachments by a standard dispenser.

Figure 4:
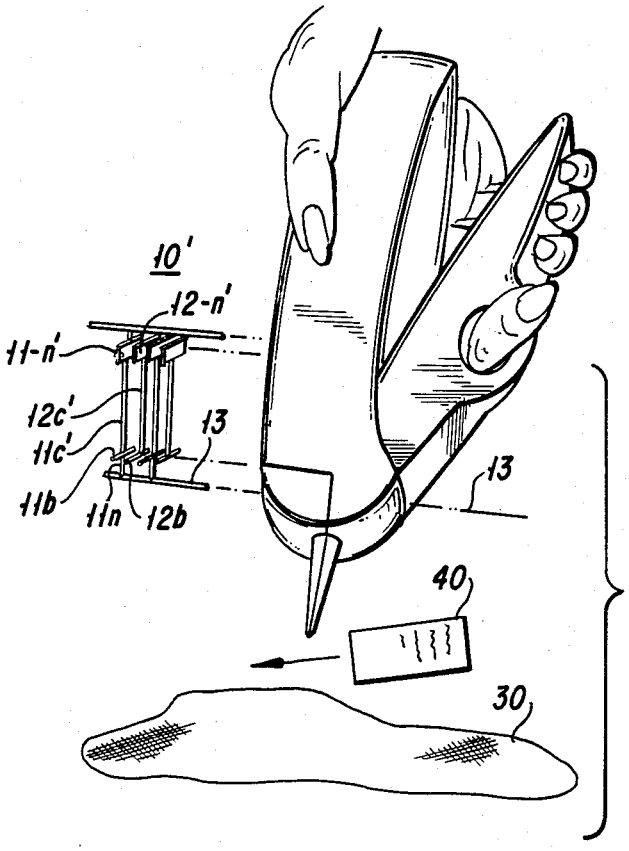
FIG. 4 is a schematic view showing a clip of attachments after having been stretched in accordance with the invention being used in a manner similar to that illustrated in FIG. 1.

For the alternative embodiment of the clip 10' in FIG. 4, the method of feed is as described above. Details for the clip 10' are set forth below.

Figure 5:
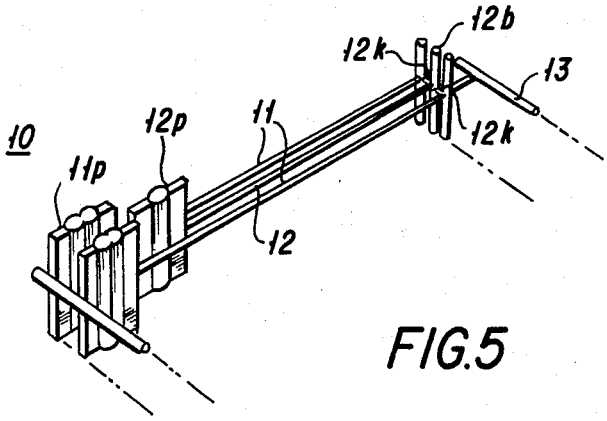
FIG. 5 is a perspective view of a fragmentary clip molded in accordance with the invention.

As more clearly indicated in FIG. 5, the clip 10 as molded is formed by a mounting element 13 which supports two sets of individual attachments 11 and 12. The attachments of the first set 11 are longer than those of the second set 12. The latter are interleaved between adjoining individual attachments at the first set 11. By making the alternate attachments 12 shorter than the adjoining attachments 11 there is a desired separation of their corresponding paddles 11*p* and 12*p* which permits the mold that is used to form the clip 10 to have a suitable wall thickness between the paddles 11*p* and 12*p*. This allows the close spacing of the attachments 11 and 12 and simultaneously permits the attachments to be produced by injection molding using customary pressures and temperature.

As explained above, the shorter attachments 12 are joined to neighboring attachments 11 at their cross bars 12*b* by narrow connectors 12*k*, there being one such pair of connectors for each of the individual attachments 12. Details for the connectors 12*k* are shown below.

Figure 6:
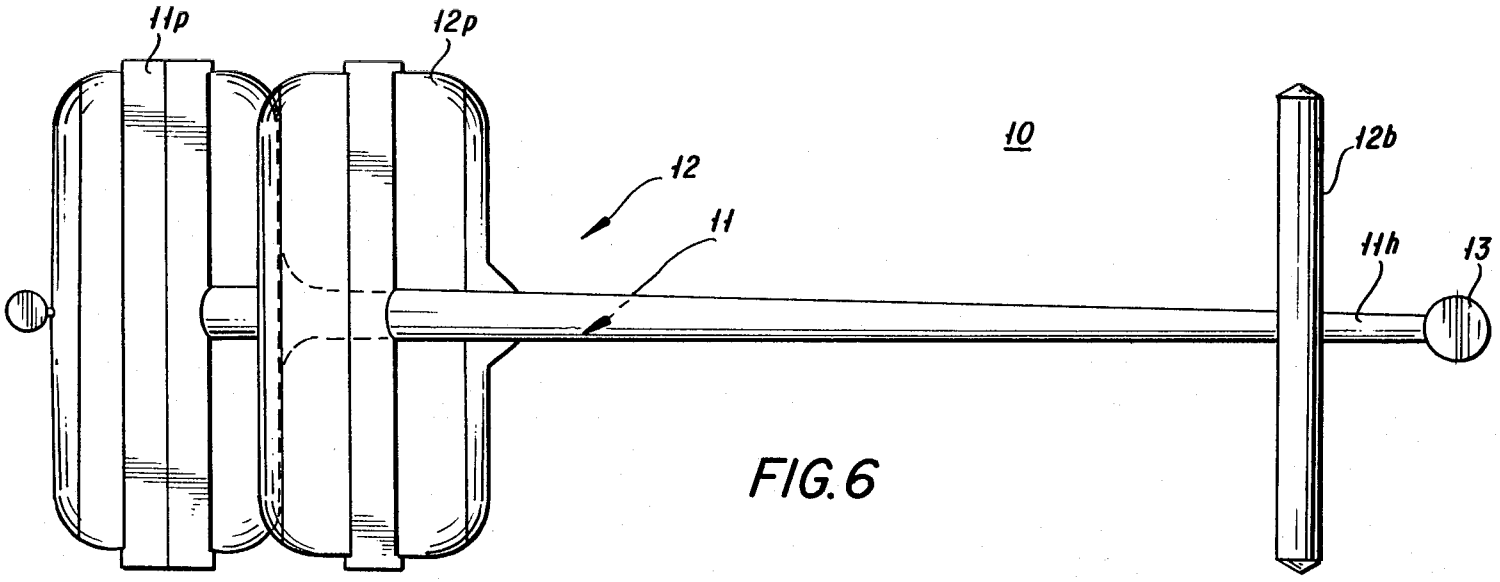
FIG. 6 is a side view of the clip of FIG. 5.

A side view of the clip 10 of FIG. 5 is shown in FIG. 6. This view emphasizes the separation between the paddles 11*p* and 12*p* that is achieved in accordance with the invention. This separation is not sufficient to interfere with the usage of the clip 10 as shown in FIG. 1. The only consequence is that alternate attachments are slightly shorter than their predecessors. In the general tagging of merchandise this is unobjectionable.

Figure 7:
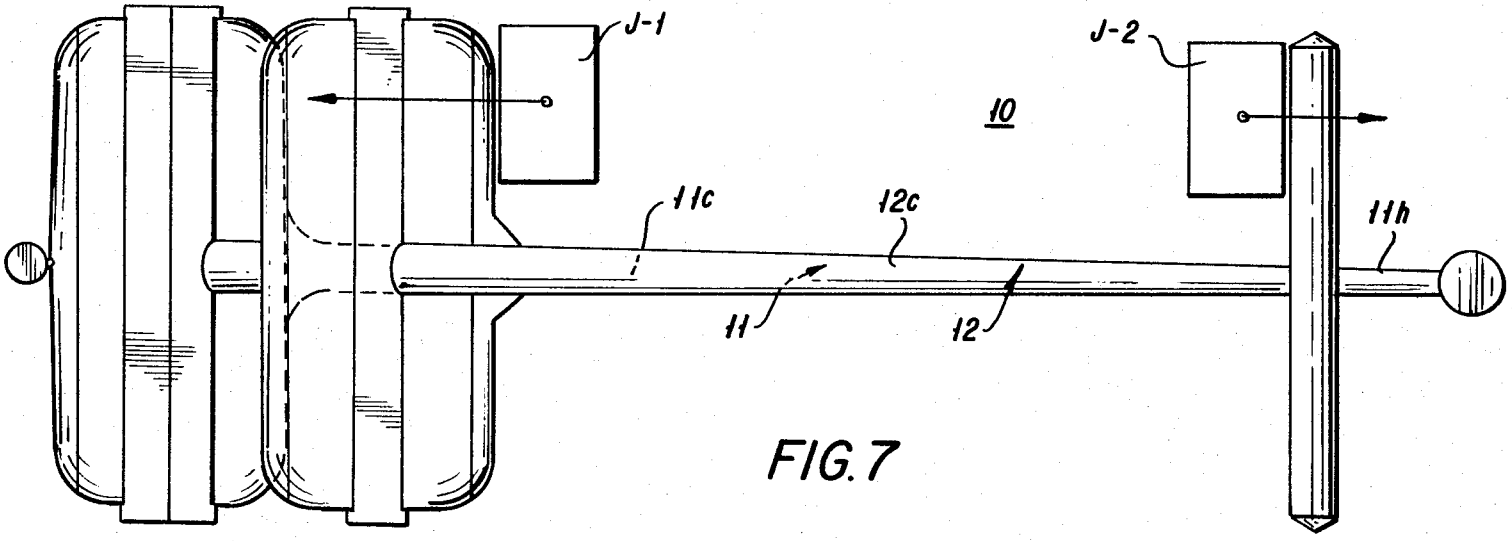
FIG. 7 is a view of FIG. 6 in conjunction with illustrative stretching jaws for producing stretched fasteners in accordance with the invention.

For those situations where it is desired to provide for the tagging of merchandise with individual attachments of equal length the invention makes use of the stretching technique illustrated by FIG. 7. In accordance with FIG. 7, the clip 10 is inserted in a stretching machine of which only illustrative stretching jaws J-1 and J-2 are shown. It will be understood that any convenient form of stretcher may be employed.

In order for stretching to take place the attachments of the clip 10 must be molded of stretch reorientable material, for example by the injection molding of plastics such as nylon, polypropylene and the like, When the clip 10 is subjected to relative separation of the jaws J-1 and J-2, initial stretching takes place only for the shorter attachments 12. Once the attachments 12 have been stretched so that their paddles 12*p* are in alignment with the paddles 11*p* of the initially longer attachments, any further spearation of the jaws will stretch both the attachments 12 and the attachments 11. The stretching may be continued until the connectors 12*c* are fully stretched. If the connectors 12*c* are molded with the same relative diameters as the connectors 11*c*, the complete stretching of the connectors 12*c* will leave an unstretched buffer zone on the initially longer connectors 11*c*. In addition, further control of the stretching is provided by the extent to which the connectors 11*c* and 12*c* are tapered increasingly from their corresponding cross bars 11*b* and 12*b*.

Figure 8A:
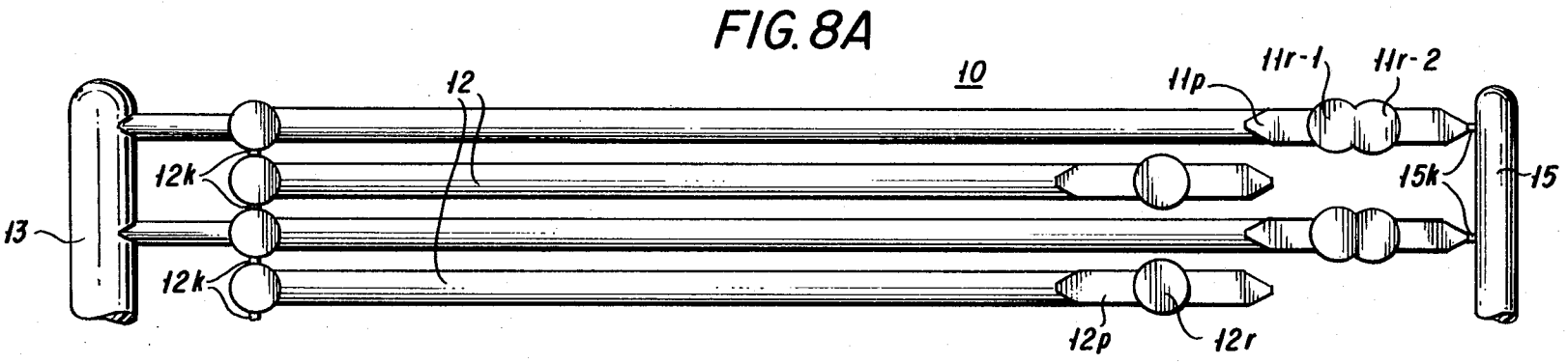
FIG. 8A is a plan view of a portion of the clip of FIG. 5 after molding and before stretching.

A plan view of the molded, unstretched attachments of FIGS. 5 through 7 is shown in FIG. 8A. The paddles 12*p* of the shorter attachments 12 include a cylindrical rib 12*r* which extends laterally across the face of the paddle and provides a protuberence that is engageable by corresponding ribs 11*r*-1 and 11*r*-2 shown on the paddle 11*p* of the longer, unstretched attachments 11. In addition, a support element 15 is joined to the paddles 11*p* of the longer attachments 11. As illustrated in FIG. 8A, the support element 15 is parallel to the mounting element 13 and is symmetrically positioned along the top edges of the paddles 11*p*. The connectors 15*k* that join the support element 15 to the paddles 11*p* are substantially the same as the connectors 12*k* that join the cross bars 12*b* of the shorter attachments 12 to the adjoining attachments 11.

Figure 8B:
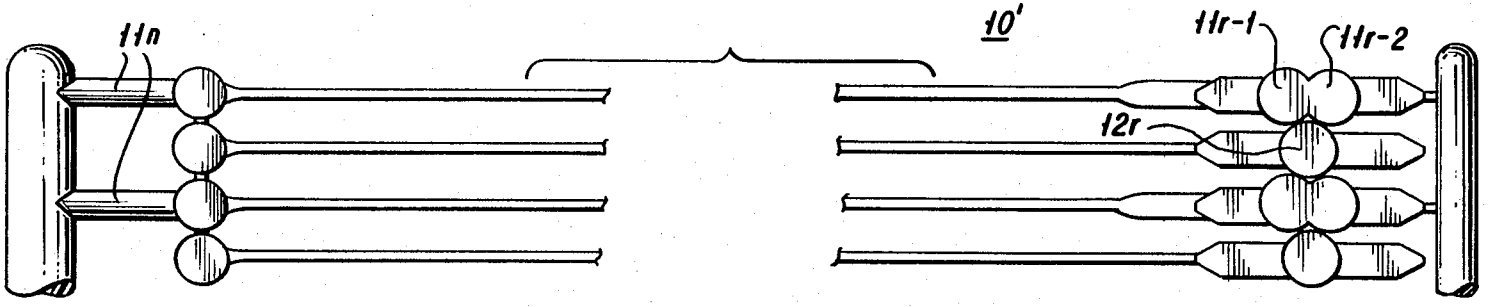
FIG. 8B is a plan view corresponding to FIG. 8A after stretching.

When the clip 10 of FIG. 8A is subjected to stretching as described previously, the paddles 12*p* of the initially shorter attachments 12 come into engagement with the paddles 11*p* of the initially longer attachments 11 as illustrated in FIG. 8B for the stretched clip 10'. As shown, the protuberence portion of the ribs 12*r* becomes interlocked between the protuberence portion of the other ribs 11*r*-1 and 11*r*-2.

In an illustrative clip 10 produced by injection molding, the connectors 11*c* and 12*c* had an illustrative minimum diameter of 0.035 inches at their cross bars 11*b* and 12*b*. The connectors 11*c* and 12*c* further had a taper extending outwardly from their positions of attachment to their respective cross bars providing an angle of taper of about 12 minutes and 21 seconds. The shorter connectors 12*c* had an unstretched length of approximately 0.739 inches, while the longer connectors 11*c* had a length of approximately 0.902 inches. The additional connector 15*k* and 12*k* that joined the support element 15 to the paddles 11*p*, and the cross bars 12*b* to the adjoining cross bars 11*b* had a maximum thickness of 0.005 inches and were either square or circular. The support element 15 had a diameter of 0.030 inches, while the mounting element 13 had a diameter of 0.060 inches. The necks 11*n* had a diameter of 0.025 inches, and a length, from the center of the connectors 12*k* to the center of the mounting element 13, of 0.116 inches. The paddles had a thickness of 0.028 inches and the ribs 12*r*, 11*r*-1 and 11*r*-2 had a diameter of 0.045 inches and where separated on a paddle, e.g. the paddle 11*p*, had a distance of separation of 0.028 inches. The paddle had a maximum width of 0.400 inches and a height of 0.187 inches.

Figure 9A:
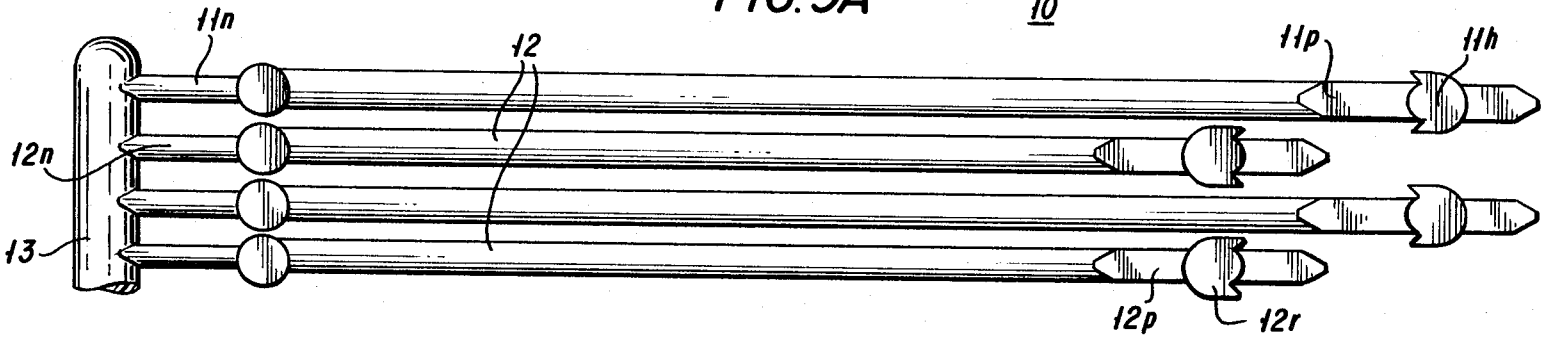
FIG. 9A is a plan view of a portion of an alternative clip in accordance with the invention after molding and before stretching.

A plan view of a portion of an alternative clip of unstretched attachments in accordance with the invention is shown in FIG. 9A. As before, the individual attachments are in two groups 11 and 12 with the individual attachments 11 being molded with a longer length than the shorter interleaved attachments 12. This permits the close spacing of the attachments as desired without requiring excessively thin mold walls in the regions of the paddles 11*p* and 12*p*. Unlike the configuration of FIG. 8A, however, the attachments of the second set 12 are directly connected to the mounting element 13. With this arrangement the interbar connections 12*k* of FIG. 8A are no longer needed and have been eliminated.

Figure 9B:
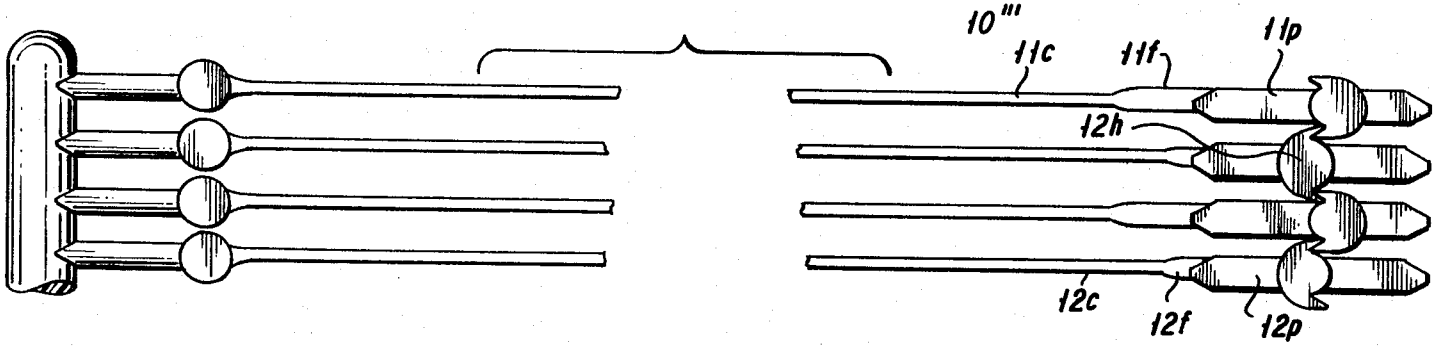
FIG. 9B is a plan view corresponding to FIG. 9A after stretching.

When the unstretched individual fasteners of FIG. 9A are stretched in accordance with procedure described previously, the result is as shown in FIG. 9B. Since the initially longer attachments 11 are not stretched to the same extent as the shorter attachments 12, there is a residual buffer region 11*f* between the adjoining paddles 11*p* and the stretched connector 11*c*'. In the case of FIG. 9B, the shorter attachments 12 also are incompletely stretched so that they too include a buffer region 12*f* between their paddles 12*p* and their stretched connectors 12*c*'.

In addition, the interengagement of the paddles 11*p* and 12*p* is achieved in the case of the embodiment of FIGS. 9A and 9B by the substitution of hook members 11*h* and 12*h* for the protuberences 11*r* and 12*r* shown in FIGS. 8A and 8B. Each of the hook members 11*h* and 12*h* has an inclined face, with respect to the longitudinal axis of the attachment, that produces the coupling engagement shown in FIG. 9B. With this arrangement the support element 15 of FIGS. 8A and 8B is unnecessary and has therefore been removed from the embodiment of FIGS. 9A and 9B.

Figure 10A:
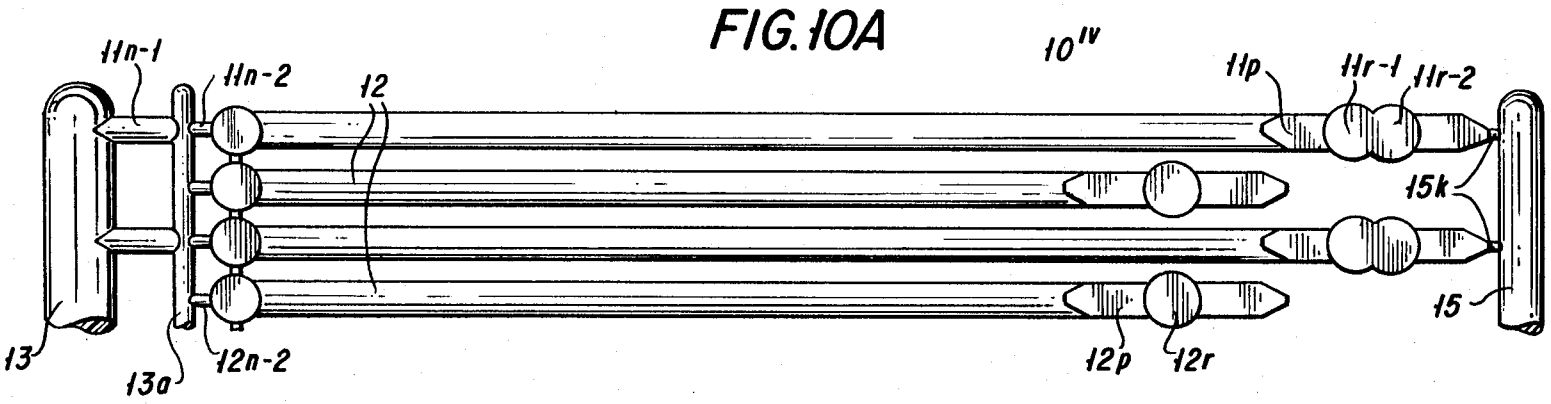
FIGS. 10A and 10B are plan views of a further alternative clip respectively before and after stretching.

A plan view of a portion of a further alternative clip of unstretched attachments in accordance with the invention is shown in FIG. 10A. As in the case of the embodiment of FIG. 9A, the interbar connectors 12*k* of FIG. 8A have been eliminated. Instead, the attachments of the shorter group 12 are connected to an auxiliary mounting element 13*a* that is positioned between the main mounting element 13 and the row of cross bars 11*b* and 12*b*. The auxiliary mounting element is approximately of the same diameter as the associated neck connectors 11*n*-1 and 11*n*-2, in the case of the longer attachments 11, and the neck 12*n*-2 in the case of the shorter attachments 12. In an illustrative embodiment of the invention the auxiliary mounting element 13*a* had substantially the same diameter as the support element 15. In one usage of the clip $10^{iv}$ the attachments 11 and 12 are advanced by a feed wheel, or other feed mechanism, which acts successively upon the necks 11*n*-1. The auxiliary mounting element 13*a* gives support to the closely spaced attachments 11 and 12 and provides a connection to the shorter attachments 12.

Figure 10B:
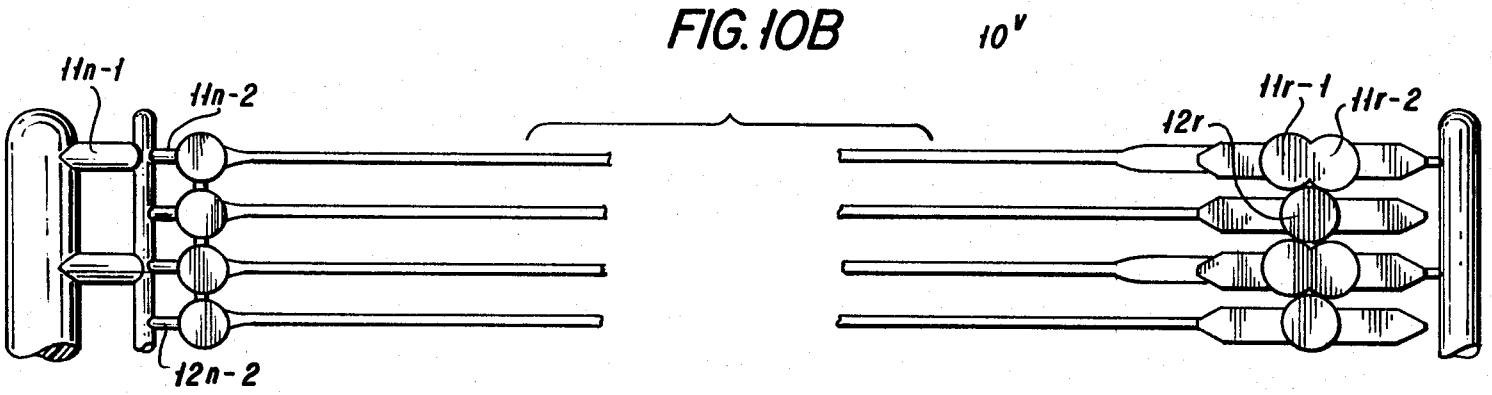
Figure 10C:
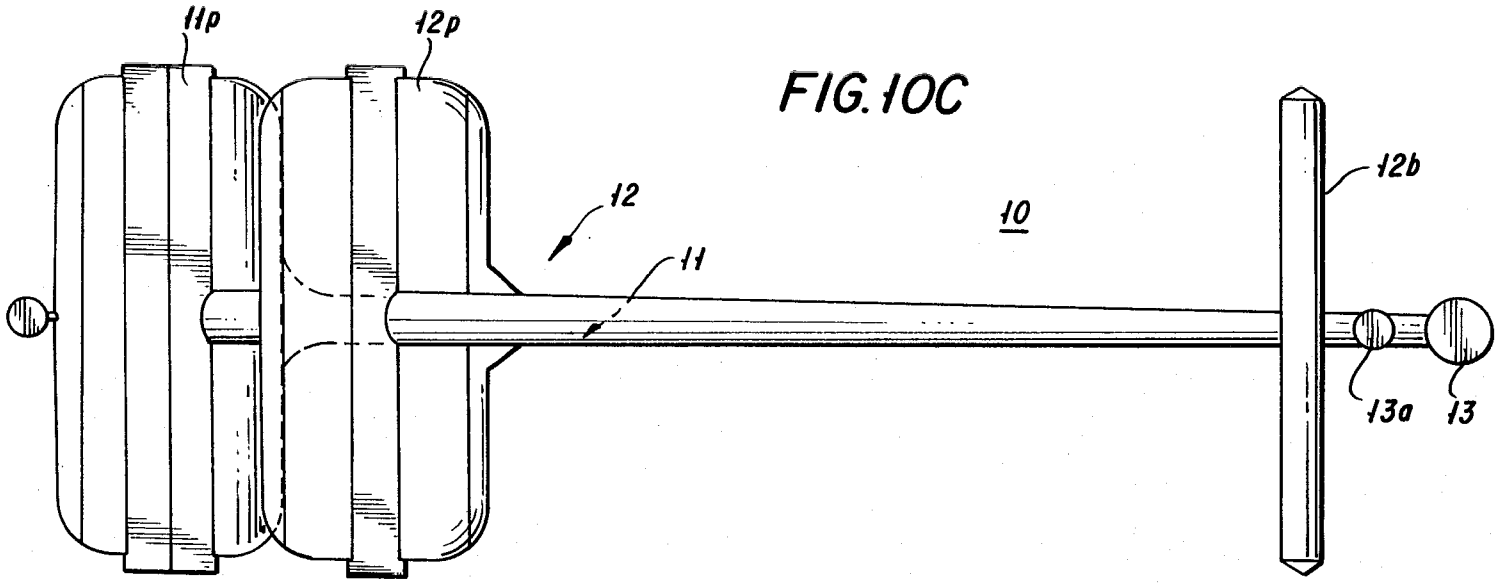
FIGS. 10C and 10D are side views corresponding to FIGS. 10A and 10B.
Figure 10D:
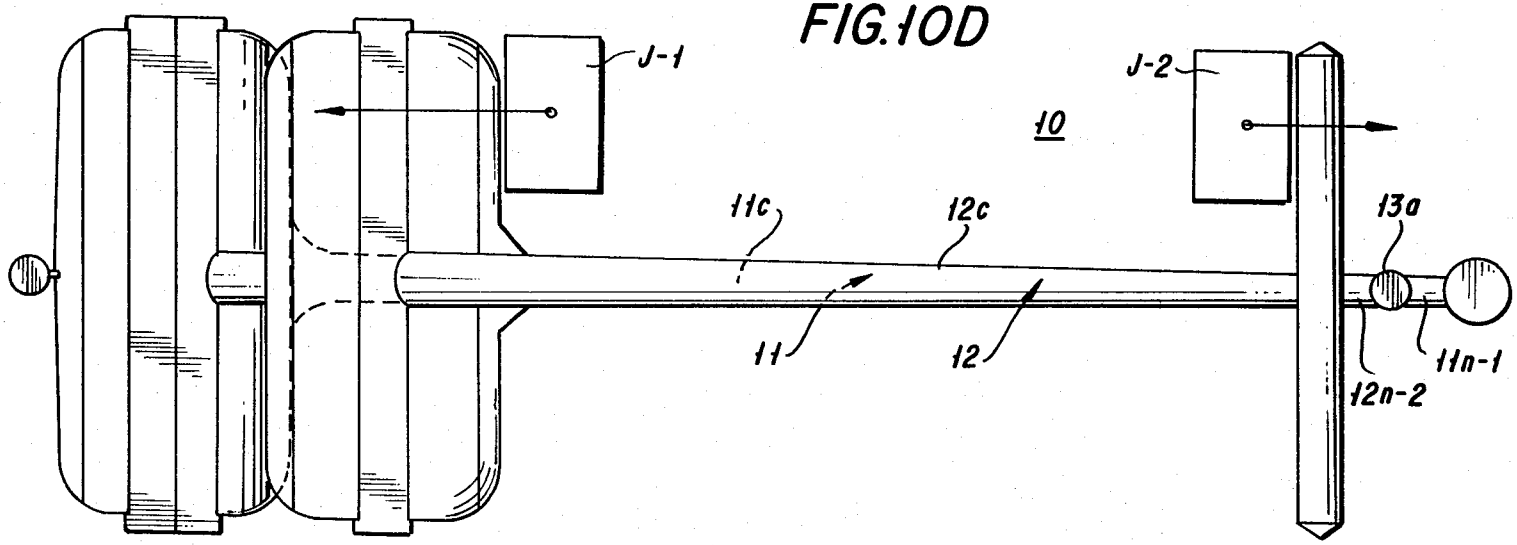

The second alternative clip $10^{iv}$ after stretching has the form $10^{v}$ as shown in FIG. 10B. The corresponding side view for respective FIGS. 10A and 10B are shown in FIGS. 10C and 10D.

While various aspects of the invention have been set forth by the drawings and specification, it is to be understood that the foregoing detailed description is for illustration only and that various changes in parts, as well as the substitution of equivalent constituents for those shown and described may be made without departing from the spirit and scope of the invention as set forth in the appended claims.

What is claimed is:

1. An assembly of attachments comprising a plurality of attachments having parts of a first type with enlarged faces, with each part joined by a elongated connector to a dispensing member;

a plurality of attachments having parts of a second type with enlarged faces, different than said parts of said first type, with each part joined by an elongated connector to a dispensing member; and means for integrally connecting said attachments to one another by way of their dispensing members;

the attachments of said first type alternating with and immediately following those of said second type with their enlarged faces in different planes.

2. An assembly of attachments in accordance with claim 1 wherein the dispensing member of each second type of attachment is joined directly to a dispensing member of each first type of attachment.

3. An assembly of attachments in accordance with claim 1 wherein each dispensing member of a first type of attachment is joined to a dispensing member of the second type of attachment by way of a mounting element for the two types of attachments.

4. An assembly of attachments in accordance with claim 1 wherein each dispensing member of a first type of attachment is joined to a dispensing member of the second type of attachment by way of an auxiliary mounting element the length of said assembly that is disposed between a main mounting element for the attachments of said first type and the dispensing members of the two types of attachments.

5. An assembly of attachments in accordance with claim 1 wherein the attachments are selectively connected to one or more mounting assembly length elements.

6. An assembly of attachments in accordance with claim 1 wherein said parts of said first type of attachments includes means for engaging and non-integrally holding a part of said second type of attachment.

7. An assembly of attachments in accordance with claim 6 wherein the holding means comprises a plurality of interlocking protuberences.

8. An assembly of attachments in accordance with claim 1 molded from thermoplastic material and the attachment of said second type is shorter and thereafter stretched to make it substantially the same length as the attachment of said first type.

9. An assembly of attachments in accordance with claim 1 wherein the attachment of the first and second type are molded from thermoplastic material and are thereafter stretched unequally to substantially the same overall length.

10. The method of manufacturing an assembly of attachments which comprises the steps of:

(a) molding a first attachment having a dispensing member with a connector extending to a further member at the opposite end of said connector;

(b) molding a second attachment which is shorter than said first attachment and having a further member which is engageable with said further member of said first attachment and being joined to said first attachment; and (c) stretching said second attachment until its further member engages that of said first attachment.

11. The method of claim 10 wherein said first attachment is molded simultaneously with said second attachment.

12. The method of claim 10 further including the molding of a mounting element to which said attachments are selectively joined.

13. The method of claim 11 further including the molding of an auxiliary mounting element to which said attachments are selectively joined.

14. The method of claim 10 further including the molding of a support member to which the further members of the attachments are selectively joined.

15. The method of applying attachments to objects which comprises the steps of (a) inserting a clip of attachments into a dispensing device, the clip including a first and second plurality of interleaved attachments selectively connected to a mounting element;

(b) advancing and dispensing a first said one of said attachments; and (c) advancing and dispensing a succeeding one of said attachments; said advance of each first and succeeding attachments being made by contact of the advancing mechanism of said dispensing device with only a single position at every other attachment of said clip.

16. The method of claim 15 wherein said clip includes a mounting element and the advance of said attachments is made by engagement of said advancing mechanism with a neck extending from said mounting element to one but not both of said attachments.

17. The method of claim 15 wherein the advancing mechanism moves a fraction of its regular advance position when the dispensing device is used with standard clips of attachments.

* * * * *